United States Patent [19]

Barthel

[11] Patent Number: 4,804,294

[45] Date of Patent: Feb. 14, 1989

[54] METHOD AND MEANS FOR IMPROVED EROSION CONTROL

[76] Inventor: Ted F. Barthel, 5588 Davis Blvd., Mentor-on-the-Lake, Ohio 44060

[21] Appl. No.: 58,172

[22] Filed: Jun. 4, 1987

Related U.S. Application Data

[63] Continuation-in-part of Ser. No. 870,155, Jun. 3, 1986.

[51] Int. Cl.[4] ..... E02B 3/06

[52] U.S. Cl. ..... 405/30; 405/21; 405/35

[58] Field of Search ..... 405/258, 15, 30, 31–35, 405/284, 285, 286, 287

[56] References Cited

U.S. PATENT DOCUMENTS

| | | | |
|---|---|---|---|
| 2,420,228 | 5/1947 | Condon | 405/286 |
| 3,444,694 | 5/1969 | Frehner | 405/286 |
| 4,379,659 | 4/1983 | Steiner | 405/284 |

FOREIGN PATENT DOCUMENTS 55-45930 3/1980 Japan .

*Primary Examiner*—Dennis L. Taylor
*Attorney, Agent, or Firm*—Mason, Fenwick and Lawrence

[57] ABSTRACT

Means for improved erosion control comprising a concrete module having a base, two upwardly extending sidewalls, an upwardly extending rearwall, a wave-disrupting ramp extending between the side walls from the base to the rear wall, and holes to aid in lifting and placement of the module and to link adjacent modules where a plurality are used to build a breakwall. A method for controlling erosion due to wave action comprising at least one module, and preferably fastening together a plurality of modules with flexible means thereby causing interference with wave action while permitting the individual modules to conform to wave action and bottom conformation.

16 Claims, 2 Drawing Sheets

FIG-4
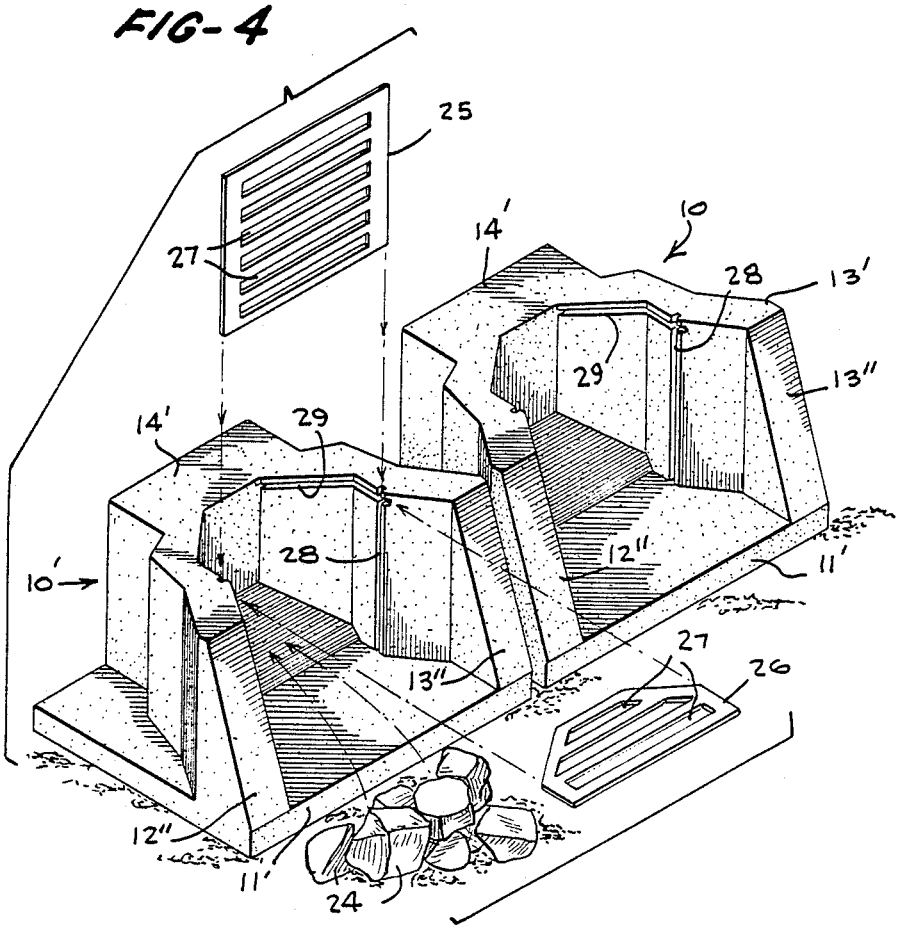
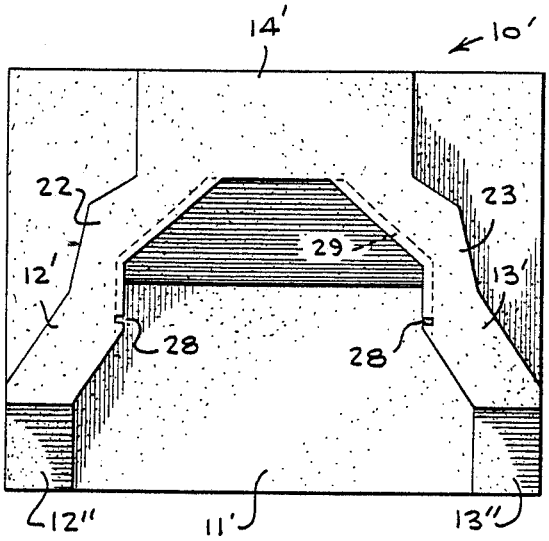
FIG-5
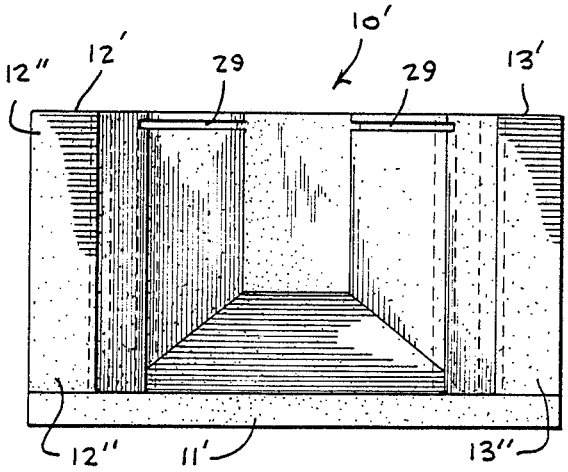
FIG-6

METHOD AND MEANS FOR IMPROVED EROSION CONTROL

BACKGROUND OF THE INVENTION

This patent is a continuation-in-part of U.S. pat. application Ser. No. 870,155, filed June 3, 1986. Now abandoned.

1. Field of the Invention.

The present invention is in the field of hydraulic and earth engineering; more specifically, this invention is in the field of improved wave dissipation and erosion control.

2. Description of the Prior Art.

In the field of erosion control and specifically in the area of protecting or restoring beaches where wave action tends to move sand onto and away from any given area over a period of time, many methods have been utilized in attempts to maintain an existing beach or to restore one which has been washed away. The methods vary in their cost and their effectiveness. For instance, a moderately effective but extremely expensive erosion-control means is the building of a wall or jetty or riprap slightly upstream or in the direction receiving the general wave action. The resulting wave action then breaks on the wall or jetty, which causes turbulence in the wave pattern and causes the flow of water to diminish in the desired beach area. With the interruption of water flow, suspended particulate material, generally sand, drops to the bottom and in a relatively short time forms a beach which is predominantly upstream and, to a lesser extent, downstream from the wall. The beach will be uneven due to the larger quantity of sand buildup on the upstream side of the jetty.

As noted above, the jetty construction is very expensive and requires heavy equipment for the emplacement of the rock. Further, the rock must be massive and hard; sandstone or shale, for instance, would be unsuitable. Therefore, in addition to the heavy equipment, a suitable source of rock must be available within an economic distance.

Where the economics of a source of massive rock do not permit its use, large wire baskets containing smaller rocks have been used. While this method is less costly to install because heavy equipment is not required, the wire tends to corrode and erode with time and the movement of the rock within the basket causes mechanical failure of the basket. Further, flotsam impelled into the basket by storm turbulence can bend and break the baskets. As a result, the rocks become dislodged which leads to a diminution of the effectiveness of this type of erosion control.

In an attempt to meet the problems described above, various methods have been tried. Campbell, in U.S. Pat. No. 3,875,850, describes a massive modular erosion-control device formed of concrete. The design of the module causes an impinging wave to break and drop the suspended sand. Morren, in U.S. Pat. No. 3,953,976, shows a wall formed of modules hingedly affixed at their ends. Rankin, in U.S. Pat. No. 4,297,052, shows a number of units installed and fastened rigidly together, no provision being made for relative movement among the units used. He teaches that under some circumstances, it is necessary to add sandbags to help retain sand and gravel from lake wave action.

In some devices employed for the protection of beach area, the weight of the device, combined with fairly constant low-amplitude motion induced by wave or current, causes the device in effect to burrow, or settle, into the floor beneath the body of water. Over time, the device can practically cease functioning as a wave-disrupting mechanism, requiring replacement of the device or more effort in placing new devices. This severely limits the effectiveness of such devices for protection of a beach.

None of the devices of references cited or the existing art have protected beaches and stopped erosion with the same economy and efficiency as the present invention.

SUMMARY OF THE INVENTION

Therefore, it is the object of the present invention to provide a new and improved water erosion control device.

Another object of the present invention is to provide an erosion control module which dissipates wave energy and retains sand along lake shores.

A further object of the present invention is to provide erosion control modules attached together by cables to form a continuous break wall which can conform to irregular shoreline contours and prevent cracking of the modules due to wave induced stresses.

A still further object of the present invention is to provide a portable erosion control module which can be manufactured and transported to the erosion site.

Another object of the present invention is to provide an erosion control module which is capable of dissipating wave energy while not sinking into the lake bottom on which it is installed.

A further object of the present invention is to provide an erosion control module which prevents scouring of sand from beneath the module by wave action.

BRIEF DESCRIPTION OF THE DRAWINGS

FIG. 4 is a perspective view of an alternative embodiment;

FIG. 5 is a top view of the alternative embodiment shown in FIG. 4;

FIG. 6 is a front view of the alternative embodiment.

DESCRIPTION OF THE PREFERRED EMBODIMENTS

The present invention provides improved control of water erosion and includes a concrete module having a base, two upwardly extending side walls, an upwardly extending rearwall, a wave-disrupting ramp extending between the side walls from the base to the rear walls and holes to aid in lifting and placement of the module and to linking adjacent modules where a plurality are used to build a breakwall. The method of the present invention includes setting the module on the floor of a body of water while the open end oriented to receive waves and current flow and connecting the modules together with cables to form a breakwall shaped as necessary to conform to a shoreline.

In the present invention, the module, singly or in combination with others, is set offshore to protect existing shorelines and structures, and to build a substantial beach. As a wave strikes the unit, both the spray and some of the flowing water pass up the ramp over the rear wall and through the holes in the side walls and rear walls to deposit sand in the quiet zone behind the module. The design of the module causes wave action from any direction to be dissipated—a result not obtained with other designs. Stated alternatively, while the performance of the module is best when its open end is oriented toward the direction from which the water flows, the module has proven effective in all aspects of installation and its protective effect is substantially independent of wave direction.

Figure 1:
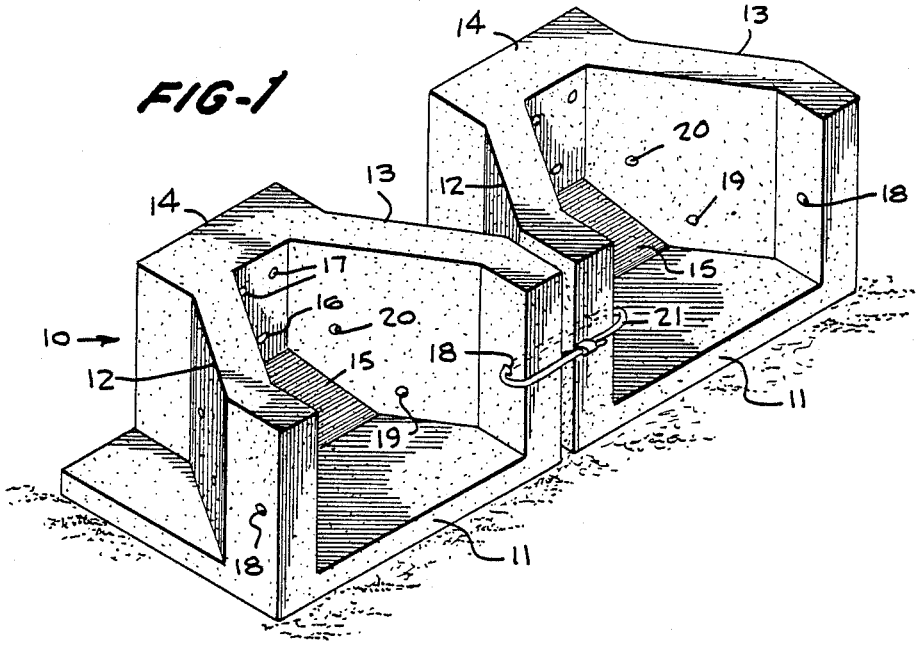
FIG. 1 is a perspective view of the preferred embodiment.
Figure 2:
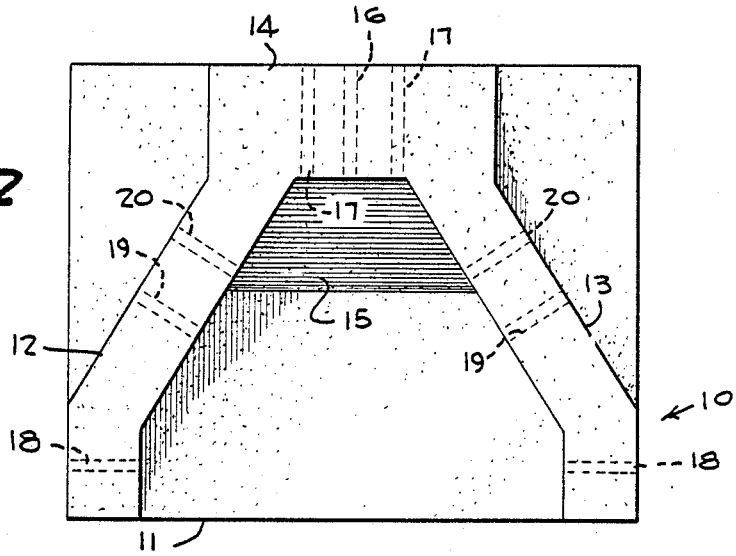
FIG. 2 is a top view of the preferred embodiment shown in FIG. 1.
Figure 3:
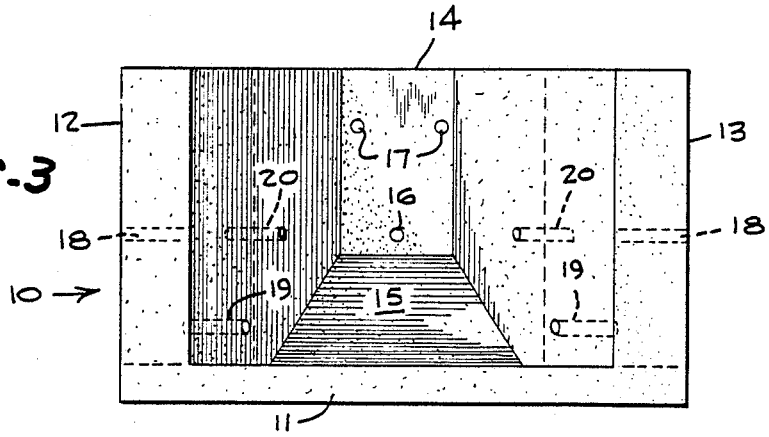
FIG. 3 is a front view of the preferred embodiment.

As shown in attached FIGS. 1, 2 and 3, the erosion control module, generally indicated with the reference numeral 10, has a base 11, upwardly extending and rearwardly converging left and right side walls 12 and 13, rear wall 14, and ramp 15 extending from the base to a central location on rear wall 14. First hole 16 and second holes 17 in rear wall 14 permit a portion of water flowing into the space defined by base 11, side walls 12 and 13, and rear wall 14 to pass through the module.

This feature reduces the net force exerted on the module by wave or current action, and contributes to a longer life of a breakwall than would be the case without the holes.

Base 11 provides a large surface area over which to distribute the weight of the module thereby reducing the bearing pressure of the module on the bottom of the body of water and preventing settling of the module as has occurred with other erosion control devices. The portions of the base 10 which extend outside the side walls 12 and 13 increase the bearing area of the base and contribute to stability of the module as sand builds up over these portions of the base.

The side walls 12 and 13 converge toward the back of the module to reduce the instantaneous build up of pressure on the module thereby reducing overturning forces applied to the module by the wave action.

Ramp 15 assists in directing a wave, entering the module, to flow vertically up the back wall 14 and into the air over the module which dissipates the wave energy as most of the water falls back into the module. The water falling back into the module is directed by the ramp 15 and base 11 horizontally back out the front of the module which causes a build up of sand forming a ledge of sand in front of the module. This sand ledge protects the module from the scouring of sand from beneath the front edge of the base which makes the module more stable than any other previous erosion control device which is not anchored to the lake bottom.

The reaction from the water being diverted vertically from the module 10 tends to hold the module against the lake, ocean or river floor beneath the body of water, rendering it even more stable and effective.

Holes 16 and 17, along with third holes 18, fourth holes 19 and fifth holes 20, each provide a dual purpose. Holes 16 and 20 are located in rear wall 11 and side walls 12 and 13 on a line passing through the center of mass of the module. Holes 17 are located in rear wall 11, above the center of mass, and holes 19 are located in arms 12 and 13 below the center of mass. The holes thus located are useful in handling the module for emplacement with holes 20 permitting general handling by means of a wire sling and the other holes affording control over yaw, pitch and roll as required.

After the module has been placed where desired and the handling slings removed, the various holes, particularly 18, serve to permit the modules to be fastened together as required as well as allowing water to pass through and thus decreasing the net force exerted on the resulting structure, while providing a continuous breakwall where desired.

The mass of the module and its construction of reinforced concrete provides resistance to the force of the water. Those skilled in the art will further realize that the holes in the modules are useful in fastening one or a plurality of modules to the floor of the body of water in which the modules are emplaced, as a further or alternative means of preventing movement of the modules. This feature is especially utilitarian to prevent movement due to ice masses in installations in the Great Lakes.

The perspective view of FIG. 1 shows a plurality of the modules of the present invention fastened together by fastening means 21 to form a breakwall. In such an arrangement, any of the holes can be used with fasteners to attach adjacent modules together in the manner shown with the fastening 21 through holes 18. Those skilled in the art will realize that this permits modules 10 to be fastened in a wide variety of configurations to accomodate either a desired shore or beach conformation or to take advantage of a particular underwater bottom configuration.

Further, while FIG. 1 shows the modules with their arms 12 and13 juxtaposed toward the flow of the water, the modules can be staggered or assembled in a configuration most suitable for the bottom conditions and current flow.

In the method of this invention, the modules 10 are placed individually, if the shoreline or beach requirements so permit and if the wave action or current is relatively gentle, or fastened together to form a continuous breakwall as shown in FIG. 1, if the current or wave action is severe. Preferably, the modules are fastened with bases 11 juxtaposed adjacent the beach, and side walls 12 and 13 directed generally toward the oncoming wave or current action. As noted hereinabove, it is within the spirit and scope of this invention to fasten the modules together in interlocking fashion if conditions require that configuration and with side walls 12 or 13 toward the predominant wave action.

Fastening means 21, shown in FIG. 1, is a flexible means, preferably one which is resistant to corrosion caused by water and air. Wire rope, preferably stainless steel, or a high-strength polymeric material such as; e.g., poly)phenylene terephthalamide) fiber, woven or braided glass fiber, or other corrosion-resistant flexible material, is chosen for fastening the modules. By the use of flexible fastening, as already noted, the modules 10 can be arranged in other than a straight-line breakwall, providing an ability to sculpture the desired beach or to conform to an existing shoreline or lake or river bottom. Further, where the wave action is vigorous, such as may be encountered with ocean waves or storms on the Great Lakes, a wave strong enough to cause relative movement between adjacent modules will not fracture the breakwall itself or shear the fastening between the modules, which could be the case if the modules were fastened rigidly.

Also in consideration of the utility of the modules on the Great Lakes, the action of the masses on a breakwall constructed in accordance with the present invention generally will not shear the flexible fastening between modules, even though the action of the ice may be enough to move the entire wall. In this case, the wall could be moved a small distance by an unusual mass of ice driven by a strong current or wind action, but the likelihood of separation of the modules is minimal.

A further advantage of the present method inheres in the flexible fastening. In the event that a fastening between modules is broken through any combination of circumstances, it is unnecessary to secure realignment of the modules to fasten them together again. In this case, a single worker with or without breathing apparatus could thread a new cable through adjacent holes 18 and tighten it as necessary without moving the modules, having a crane brought in, or building a cofferdam around the site.

Those skilled in the art will realize that ramp 15 can be flat, as depicted in the drawings, a series of discrete steps, or curved. The surface of ramp 15 can start asymptotically with the base rising through an ascending angle until meeting rear wall 20 asymptotically at its surface, such as paraboloid or hyperboloid. The choice of ramp surface characteristic is a function of the nature of the current encountered and the shoreline to be protected.

While not shown in the drawings, those skilled in the art will realize that under some extreme circumstances, such as on the Great Lakes, where ice movement can disrupt movable devices, the modules can be fastened into the floor of the body of water. This can be effected in any number of ways such as drilling into base rock and employing rock anchors, and using cement in a natural or prepared hole.

The alternative embodiment of the present invention shown in FIGS. 4, 5 and 6 includes the module 10' with base 11' and rearwardly converging left and right sidewalls 12' and 13' having outwardly diverging portions 22 and 23 which, with rear wall 14', form a pocket to contain rocks 24. The rocks, preferably 20 to 30 inches in diameter, are contained in this pocket by a grate 25 across the front of the pocket and a grate 26 over the top of the pocket which prevents wave action from moving the rocks. The purpose of the rocks in this embodiment is to help dissipate the wave energy and reduce the amount of spray created by the module.

Grates 25 and 26 are formed by cutting rectangular openings 27 in sheet metal configured to slide beneath guide way 28 and 29 formed in the module. Holes, similarly located as those in module 10, can be formed for lifting and attaching adjacent modules. Other devices for lifting and attaching modules, such as depressions or hooks, can be used in this invention. In this alternative embodiment, the side walls 12' and 13' have sloping front edges 12'' and 13'' which reduce the overturning moment on the module caused by the pressure of water striking these edges. Preferably, front edges 12'' and 13'' form a 67.5° angle with the base 11.

Rock can be installed in the preferred embodiment of the invention to accomplish the same results.

An addition alternative embodiment of this invention would be to eliminate the rear wall 14 and ramp 15, as shown in FIGS. 1, 2 and 3, and have side walls 12 and 13 converge together toward the rear of the base. This configuration will perform efficiently; however, it has been found to wear rapidly.

From the foregoing detailed description, it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

I claim:

1. An erosion control module for dissipating wave energy and retaining beaches along the shoreline of a body of water comprising a base for contacting the floor of the body of water to distribute the weight of the erosion control module and produce low bearing pressures on the floor of the body of water, a pair of side walls extending upwardly from said base with said side walls converging toward the rear of said base and with said base extending between said side walls, a rear wall upwardly extending from the rear of said base and extending between said side walls to provide extended life to said module and direct water entering the module in an upward direction, and a means for forming a sand ledge in front of said module thereby creating an erosion control module which is stable and effective.

2. The erosion control module of claim 1 wherein said means for forming a sand ledge includes a ramp extending between said side wall from said base to said rear wall to disrupt waves entering said module and assist in directing the waves in an upward direction.

3. The erosion control module of claim 1 additionally including flexible means for attaching a plurality of said modules together.

4. The erosion control module of claim 2 additionally including flexible means for attaching a plurality of said modules together.

5. The erosion control module of claim 1 additionally including a hole through each of said side walls to permit a plurality of said modules to be attached together by wire rope extending through at least one of said holes in adjacent modules.

6. The erosion control module of claim 1 additionally including a hole in each of said side walls with said holes positioned such that a line passing through the holes will also pass through the center of gravity of said module thereby providing controlled movement when the module is being transported by lifting hooks inserted in the holes.

7. The erosion control module of claim 2 additionally including a hole in each of said side walls with said holes positioned such that a line passing through the holes will also pass through the center of gravity of said module thereby providing controlled movement when the module is being transported by lifting hooks inserted in the holes.

8. The erosion control module of claim 1 additionally including at least one hole in said rear wall to reduce water pressure on said rear wall and provide a means for controlling movement when the module is being transported.

9. The erosion control module of claim 2 additionally including at least one hole in said rear wall to reduce water pressure on said rear wall and provide a means for controlling movement when the module is being transported.

10. An erosion control module for dissipating wave energy and retaining beaches along the shore line of a body of water comprising a base, a pair of side walls extending upwardly from said base with said side walls generally converging toward the rear of said base with a diverging portion intermediate the ends of said side walls and with said base extending between said side walls, a rear wall upwardly extending from the rear of said base and extending between said side walls, a means for retaining riprap or rocks in the pocket formed by the diverging position of said side walls, the base and the rear wall and a means for forming a sand ledge in front of said module thereby providing an erosion control module which dissipates wave energy and reduces spray.

11. The erosion control module of claim 10 additionally including flexible means for attaching a plurality of said modules together.

12. The erosion control module of claim 1 additionally including a rearwardly inclined portion on the front edge of each side wall.

13. The erosion control module of claim 10 additionally including a rearwardly inclined portion on the front edge of each side wall.

14. The erosion control module of claim 1 additionally including a means for retaining riprap or rocks between said side walls.

15. The erosion control module of claim 2 additionally including a rearwardly inclined portion on the front edge of each side wall.

16. The erosion control module of claim 2 additionally including a means for retaining riprap or rocks between said side walls.

* * * * *